US007874510B2

(12) United States Patent
Martin et al.

(10) Patent No.: US 7,874,510 B2
(45) Date of Patent: Jan. 25, 2011

(54) STRAP DISPENSER APPARATUS

(76) Inventors: Michael Martin, 143 Huggard Rd SE, Calgary, Alberta (CA) T3Z 2C2; David Thiessen, General Delivery, Arthur Town, Cat Island (BS)

( * ) Notice: Subject to any disclaimer, the term of this patent is extended or adjusted under 35 U.S.C. 154(b) by 0 days.

(21) Appl. No.: 11/972,661

(22) Filed: Jan. 11, 2008

(65) Prior Publication Data

US 2009/0179103 A1 Jul. 16, 2009

(51) Int. Cl.
*B65H 16/02* (2006.01)

(52) U.S. Cl. ..... 242/595.1; 242/557; 242/403

(58) Field of Classification Search ..... 242/557, 242/403.1, 403, 595.1, 595, 421, 422.5; 411/911; 414/911, 433, 24.6
See application file for complete search history.

(56) References Cited

U.S. PATENT DOCUMENTS 1,374,379 A * 4/1921 Klein ..... 280/47.2
2,122,674 A * 7/1938 Wardle ..... 242/564.1
2,285,358 A * 6/1942 Rode et al. ..... 242/564.5
2,489,432 A 11/1949 Peters
2,506,354 A 5/1950 Green
2,654,550 A 10/1953 Winkler
2,660,381 A * 11/1953 Friedl et al. ..... 242/557
3,685,760 A 8/1972 Fedor
3,826,443 A 7/1974 Goodly
3,889,831 A * 6/1975 Davis ..... 414/433
3,995,758 A 12/1976 Kovaleski
4,422,596 A 12/1983 Cleavenger
5,931,484 A 8/1999 Jones et al.
6,419,424 B1 7/2002 Null et al.
6,471,154 B1 10/2002 Toth

* cited by examiner

*Primary Examiner*—Michael R Mansen
*Assistant Examiner*—Juan J Campos
(74) *Attorney, Agent, or Firm*—Maxey Law Offices, PLLC; Stephen Lewellyn

(57) ABSTRACT

Device for dispensing strapping material from a coil of the strapping material includes a carriage for receiving the coil of material such that the coil can be rotated about a longitudinal axis of the coil by pulling the material from the coil to unwind the material from the coil. The carriage supports the coil at circumferential spaced locations on the periphery of the coil, is adjustable to various widths or thickness of the coil, and operates to apply a proportional braking force to the coil at circumferential spaced locations on the periphery of the coil as a function of the weight of the coil. The carriage is mounted to a wheeled cart that includes various receivers for storing tools and supplies used in the process of bundling articles together with strapping.

7 Claims, 8 Drawing Sheets

STRAP DISPENSER APPARATUS

FIELD OF THE INVENTION

The present invention relates generally to an apparatus for dispensing package strapping from a coil, and more particularly, relating to an apparatus for dispensing strapping from a coil that includes an improved coil receiving carriage assembly that supports a coil at circumferential spaced locations on the periphery of the coil and which is adjustable to various widths or thickness of the coil. The invention further relates to an apparatus for dispensing strapping from a coil that applies a proportional braking force to the coil at circumferential spaced locations on the periphery of the coil.

BACKGROUND

It is known to dispense strapping from a coil of the material by pulling the material to unwind it from the coil. The coil of strapping material maybe wound onto a core having a width or thickness equal to the width of the strapping or onto a core having a width or thickness greater than the strapping and is traversed back and forth across the core during winding. Additionally, the inner diameter of the core or coil can vary greatly depending upon the type of material, the width of the strapping, the quantity of the strapping and the manufacture of the strapping. The removal of the strapping from the coil as desired has always presented many problems. It is desirable to support the coil for rotation to permit removal of the strapping by pulling the material from the coil. Many complex mandrills or reels for rotatably supporting coils of strapping have heretofore been devised in an attempt to accommodate coils of various thickness or of various inner diameters. However, these devices do not provide a solution to both the problem of supporting coils of various thickness and of various inner diameters, but rather only address one or the other, and tend to be difficult to operate and expensive to manufacture. Additionally, these devices require the coil or reel to be axially loaded onto the spindle for supporting the coil or reel.

Another problem exists when the strapping is pulled from the rotatably supported coil. The momentum of the coil of the material, especially caused by the initial force required to start the coil turning from rest, tends to result in overrunning. Overrunning, is a condition where the coil continues to rotate after the operator has stopped pulling on the strapping or where the operator cannot keep up with the rate at which it is unwound from the coil. Overrunning, in addition to an excess of strapping being unwound from the coil, can result in a looseness among the outer turns of the strapping which can cause the turns to become crossed, expand or enlarge beyond the diameter of the coil and bind the coil against rotation.

Many reel or coil braking devices have been proposed and used to prevent overrunning. While these devices provide braking and may prevent overrunning they create additional objectionable characteristics. Foremost, the prior braking devices operate to apply a constant braking force against the rotation of the coil or reel as the strapping is being pulled from the coil creating a drag opposing the operator's pull. The problem with applying a constant braking force is the weight of the coil is not taken into consideration. A full coil of strapping is substantially heavier than a coil that has had strapping removed. As strapping is removed from the coil, the weight of the coil is reduced, thereby reducing the coil momentum and the amount of braking force required to prevent overrunning. In the devices heretofore, the braking force is initially set for the weight of a full coil of strapping, and this force is not adjusted as the weight is reduced, resulting in an increasing amount of drag the operate must work against. In other words, while the braking force remains constant, the required force for braking is lowered as the weight of the coil is reduced as a result of a lower coil momentum, and as a result, the operator must pull harder against the brake to compensate for this reduced momentum.

Accordingly, there is a need for a strap dispenser apparatus that is adjustable to the thickness of the coil and is not limited to the inner diameter of the coil. Further, there is a need for a strap dispensing apparatus where the coil can be loaded either from the front, top or side and supported for rotation. Further, there is a needed for proportional braking of the coil to prevent overrunning.

SUMMARY OF THE INVENTION

The present invention addresses these needs by providing an apparatus for dispensing strapping from a coil that includes an improved coil receiving carriage assembly that supports a coil at circumferential spaced locations on the periphery of the coil and which is adjustable to various widths or thickness of the coil, and by providing an apparatus for dispensing strapping from a coil that applies a proportional braking force to the coil at circumferential spaced locations on the periphery of the coil.

In general, in one aspect, an apparatus permitting a material to be unwound from a coil of the material while applying a proportional braking force to the coil as the diameter of the coil is reduced by unwinding the material from the coil of the material is provided. The apparatus includes a carriage for receiving a coil of material such that the coil can be rotated about a longitudinal axis of the coil by pulling the material from the coil to unwind the material from the coil. First and second laterally spaced and parallel weight transfer rollers. First and second laterally spaced and parallel force application devices. The first weight transfer roller being linked to the first force application device, and the second weight transfer roller being linked to the second force application device. The first and the second weight transfer rollers are caused to contact the coil of material at circumferentially spaced locations on the periphery of the coil and are caused to moved downwardly and outwardly in opposite directions along separate and respective arcuate paths by the weight of the coil of material when the coil of material is received by the carriage. The first and the second force application devices being biased against the coil of material at circumferentially spaced locations on the periphery of the coil of material by the downwardly and outwardly movement of the first and the second weight transfer rollers respectively for applying frictional resistance to the rotation of the coil of material.

In general, in another aspect, frictional resistance is applied as a function of the weight of the coil of material on the first and the second weight transfer rollers.

In general, in another aspect, a cart enabling a material to be unwound from a coil of the material while applying a proportional braking force to the coil as the diameter of the coil is reduced by unwinding the material from the coil of the material. The cart includes a wheeled framed, and carriage on the frame for receiving a coil of material such that the coil can be rotated about a longitudinal axis of the coil by pulling the material from the coil to unwind the material from the coil. First and second laterally spaced and parallel weight transfer rollers. First and second laterally spaced and parallel force application devices. A first carriage arm having opposed first and second ends, the first force application device being attached at the first end of the first carriage arm, the first weight transfer roller being attached at the second end of the first carriage arm. A second carriage arm having opposed first and second ends, the second force application device being attached at the first end of the second carriage arm, the second weight transfer roller being attached at the second end of the second carriage arm. The first and the second carriage arms pivotally attached to the carriage. The first and the second weight transfer rollers are caused to contact the coil of material at circumferentially spaced locations on the periphery of the coil and are caused to moved downwardly and outwardly in opposite directions along separate and respective arcuate paths by the weight of the coil of material when the coil of material is received by the carriage. The first and the second force application devices being biased against the coil of material at circumferentially spaced locations on the periphery of the coil of material by the downwardly and outwardly movement of the first and the second weight transfer rollers respectively for applying frictional resistance to the rotation of the coil of material.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
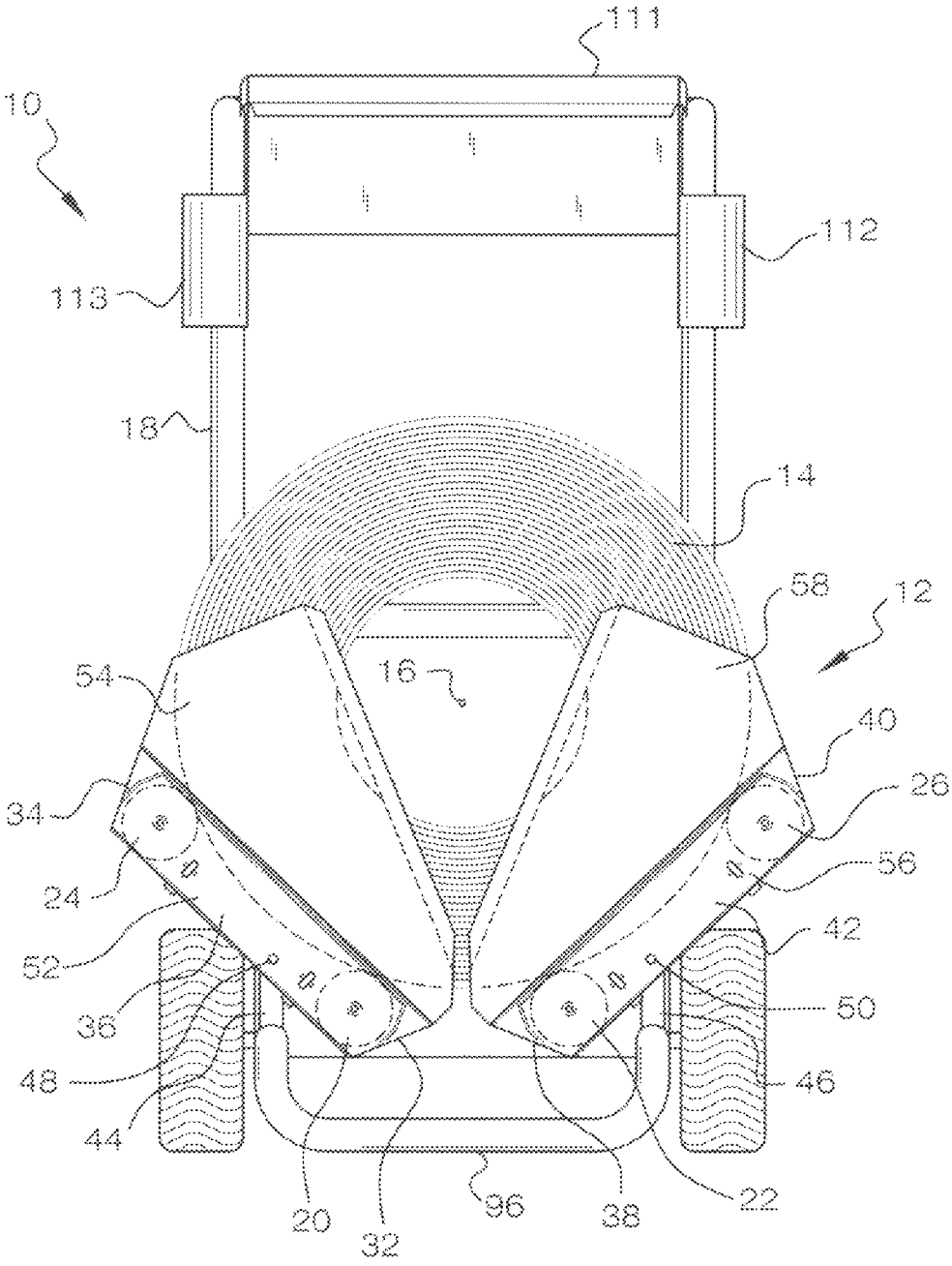
FIG. 1 is a front elevation view of the strap dispenser apparatus constructed in accordance with the principles of the present invention, with a coil of strapping material received by the carriage and ready to be dispensed from the coil.

Referring now to the drawings, reference numeral 10 generally designates the strap dispenser apparatus of the present invention. With particular reference to FIG. 1, the apparatus 10 includes a carriage 12 for supporting a coil 14 of strapping material for use in bundling articles together. The carriage 12 is configured to receive the coil 14 such that the coil can be rotated about a longitudinal axis 16 of the coil, that is directed normal to the plane of the drawing in FIG. 1, by pulling the material from the coil to unwind the material from the coil. The carriage 12 generally supports the coil 14 in a vertical orientation at circumferentially spaced locations on the periphery of the coil. The carriage 12, operates to permit strapping material to be unwound from the coil 14 while applying a weight proportional braking force to the coil as the diameter of coil is reduced by the unwinding of the material. To permit portability, the carriage 12 is mounted on a wheeled cart 18 as shown throughout the figures of the drawings.

Figure 3:
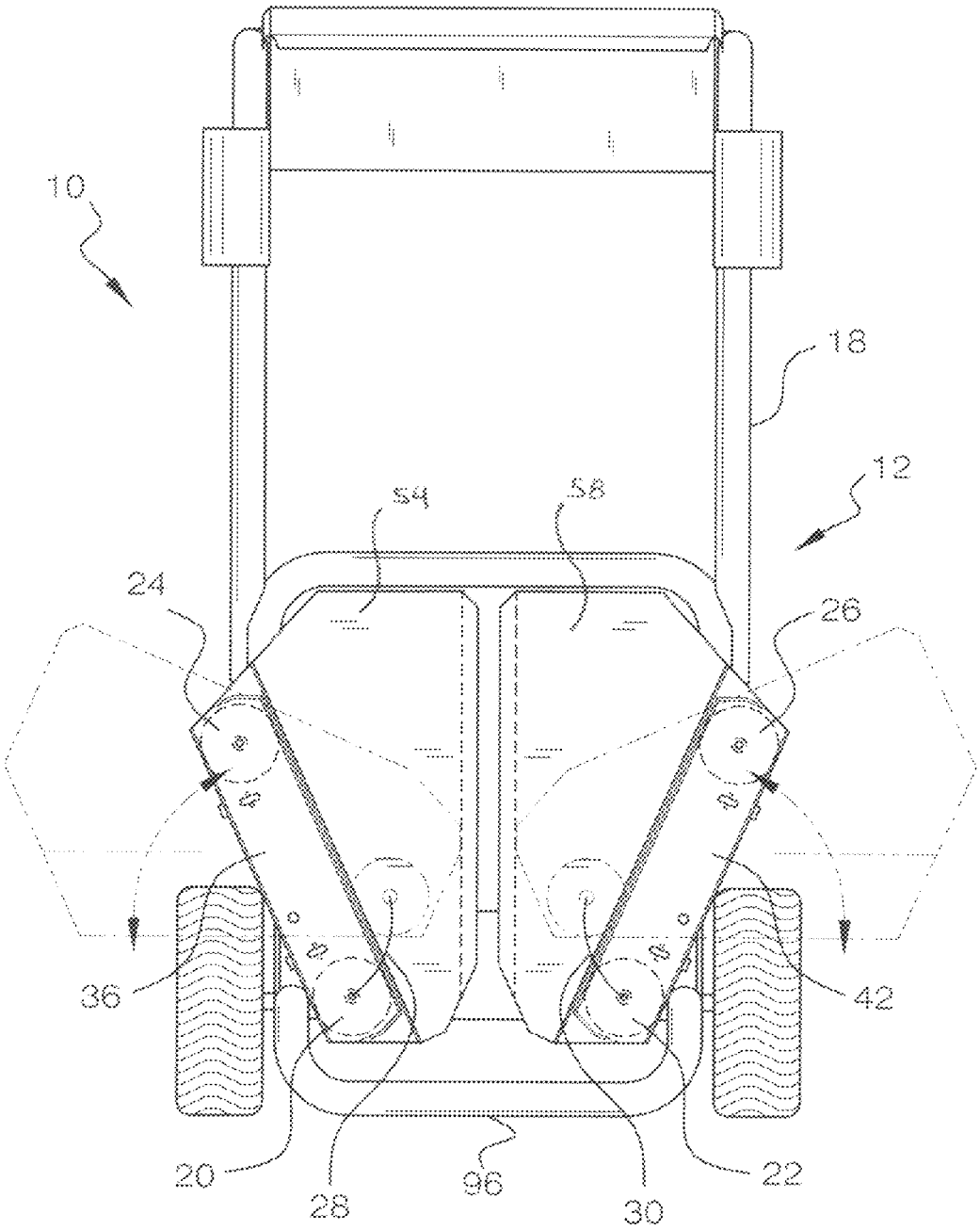
FIG. 3 is a front elevation view of the strap dispenser apparatus showing the motion of the carriage.

The carriage 12 includes two laterally spaced and parallel weight transfer rollers 20 and 22, and two laterally spaced and parallel force application devices 24 and 26. The first weight transfer roller 20 is linked to the first force application device 24, and the second weight transfer roller 22 is linked to the second force application device 26. The first and second weight transfer rollers 20 and 22 are caused to contact the coil 14 at circumferentially spaced locations on the periphery of the coil and are caused to move downwardly and outwardly in opposite directions along separate and respective arcuate paths 28 and 30, as shown in FIG. 3, by the weight of the coil as the coil is received by the carriage 12. The first and the second force applications devices 24 and 26 are biased against the coil 14 at circumferentially spaced locations on the periphery of the coil by the downward and outward movement of the first and the second weight transfer rollers 20 and 22 respectively, and apply frictional resistance to the rotation of the coil 14 about the axis 16. The first and the second force application device 24 and 26 each may be a brake roller which applies rolling frictional resistance to the rotation of the coil 14.

The first weight transfer roller 20 and the first brake roller (force application device) 24 are rotatably supported at opposite ends 32 and 34 of a first carriage arm 36, respectively. The first carriage arm 36 provides the linking between the first weight transfer roller 20 and the first brake roller 24. The second weight transfer roller 22 and the second brake roller (force application device) 26 are rotatably supported at opposite ends 38 and 40 of a second carriage arm 42, respectively. The second carriage arm 42 provides the linking between the second weight transfer roller 22 and the second brake roller 26. As shown, the first carriage arm 36 comprises a single link between the first weight transfer roller 20 and the first brake roller 24. Additionally, there are no intermediate rollers positioned between the first weight transfer roller 20 and the first brake roller 24 along the first carriage arm 36. Likewise, the second carriage arm 42 comprises a single link between the second weight transfer roller 22 and the second brake roller 26. Additionally, there are no intermediate rollers positioned between the second weight transfer roller 22 and the second brake roller 26.

The carriage arms 36 and 42 are each pivotally supported by the carriage 12 at supports 44 and 46 respectively. Each carriage arm 36 and 42 is pivotally attached to its respective support 44 and 46 with the weight transfer rollers 20 and 22 positioned inwardly of the carriage 12, and with the brake rollers 24 and 26 positioned outwardly of the weight transfer rollers 20 and 22 respectively. More particularly, the first carriage arm 36 is pivotally attached to support 44 at a position between ends 32 and 34 thereof at a position 48 located a first distance from end 34 and a second distance from the end 32, the second distance being less than the first distance. In other words, the first carriage arm 36 is pivotally attached to the support 44 at position 48 that is off center of the carriage arm towards end 32. Likewise, the second carriage arm 42 is pivotally attached to support 46 at a position between ends 38 and 40 thereof at a position 50 located a first distance from the end 40 and at a second distance from end 38, the second distance being less than the first distance. Again, in other words, the second carriage arm 42 is pivotally attached to support 46 at position 50 that is off center of the carriage arm toward end 38.

Figure 4:
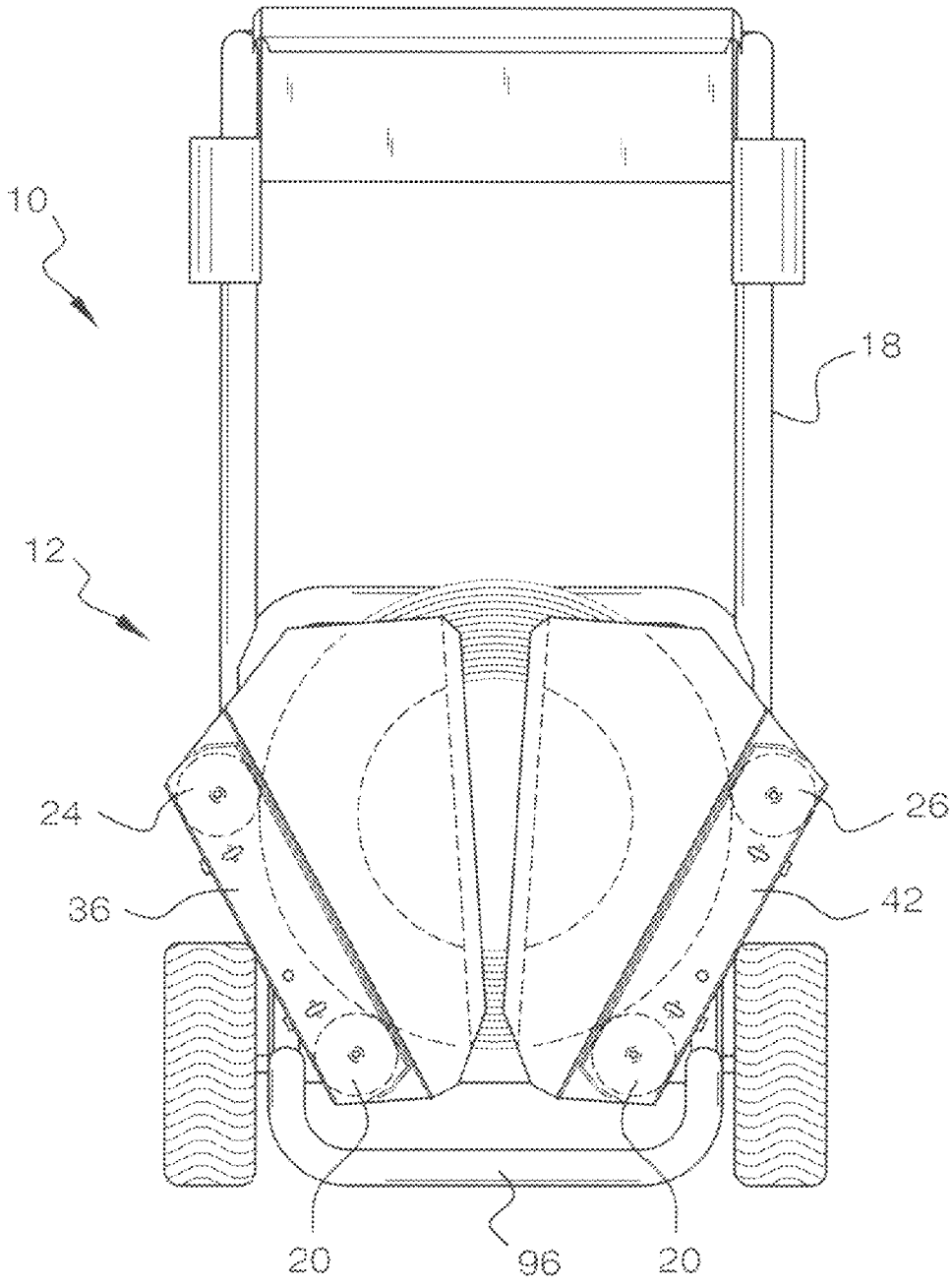
FIG. 4 is a front elevation view of the strap dispenser apparatus of FIG. 1 with a reduced diameter coil.
Figure 5:
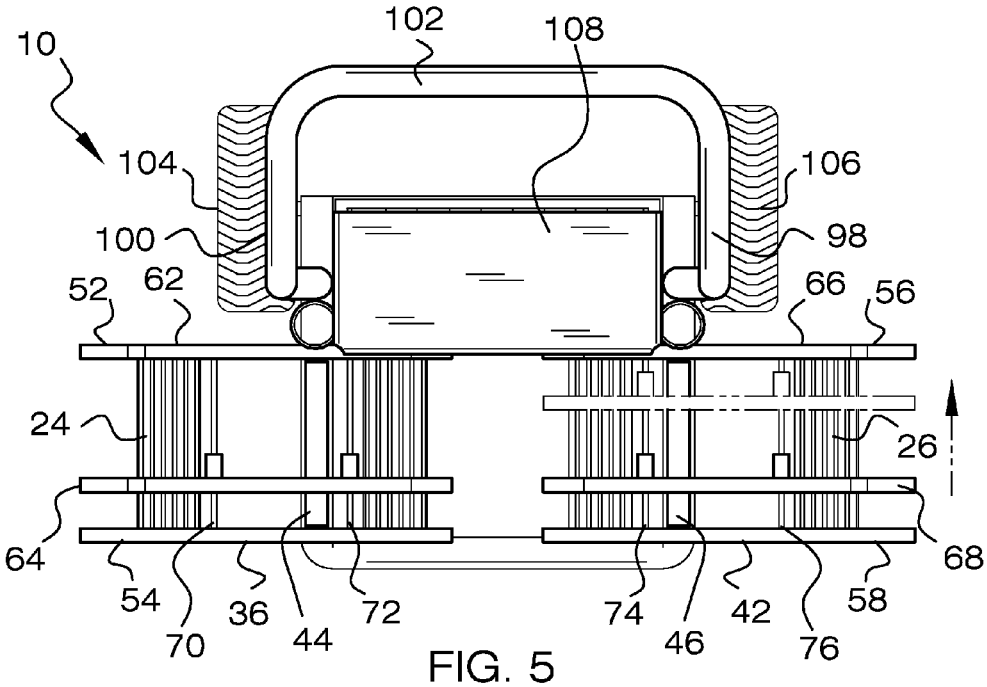
FIG. 5 is a top plan view of the strap dispenser apparatus.
Figure 6:
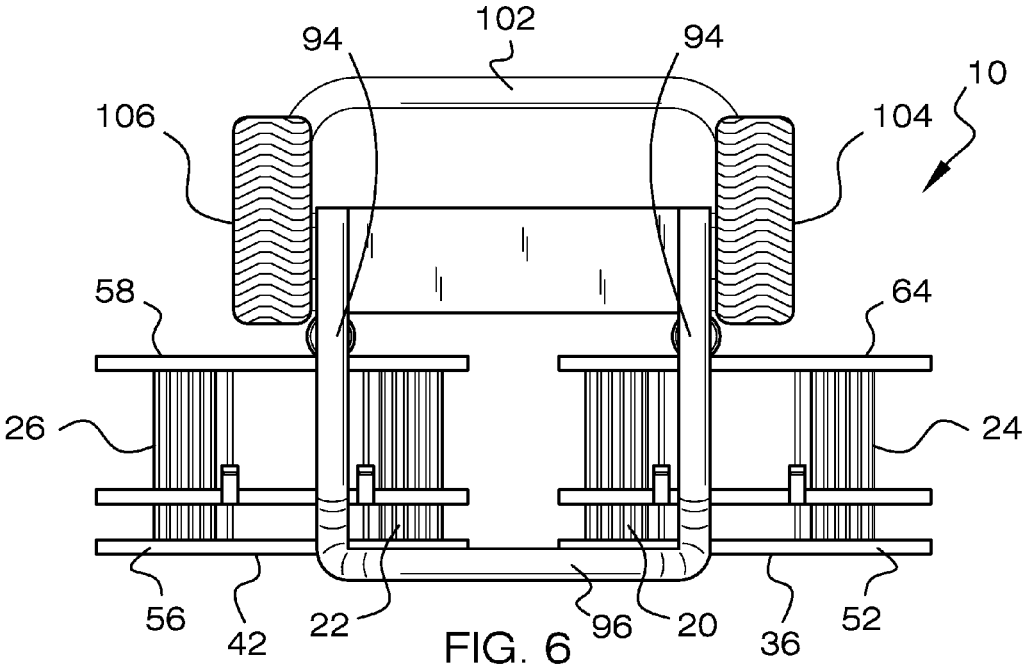
FIG. 6 is a bottom plan view of the strap dispenser apparatus.
Figure 7:
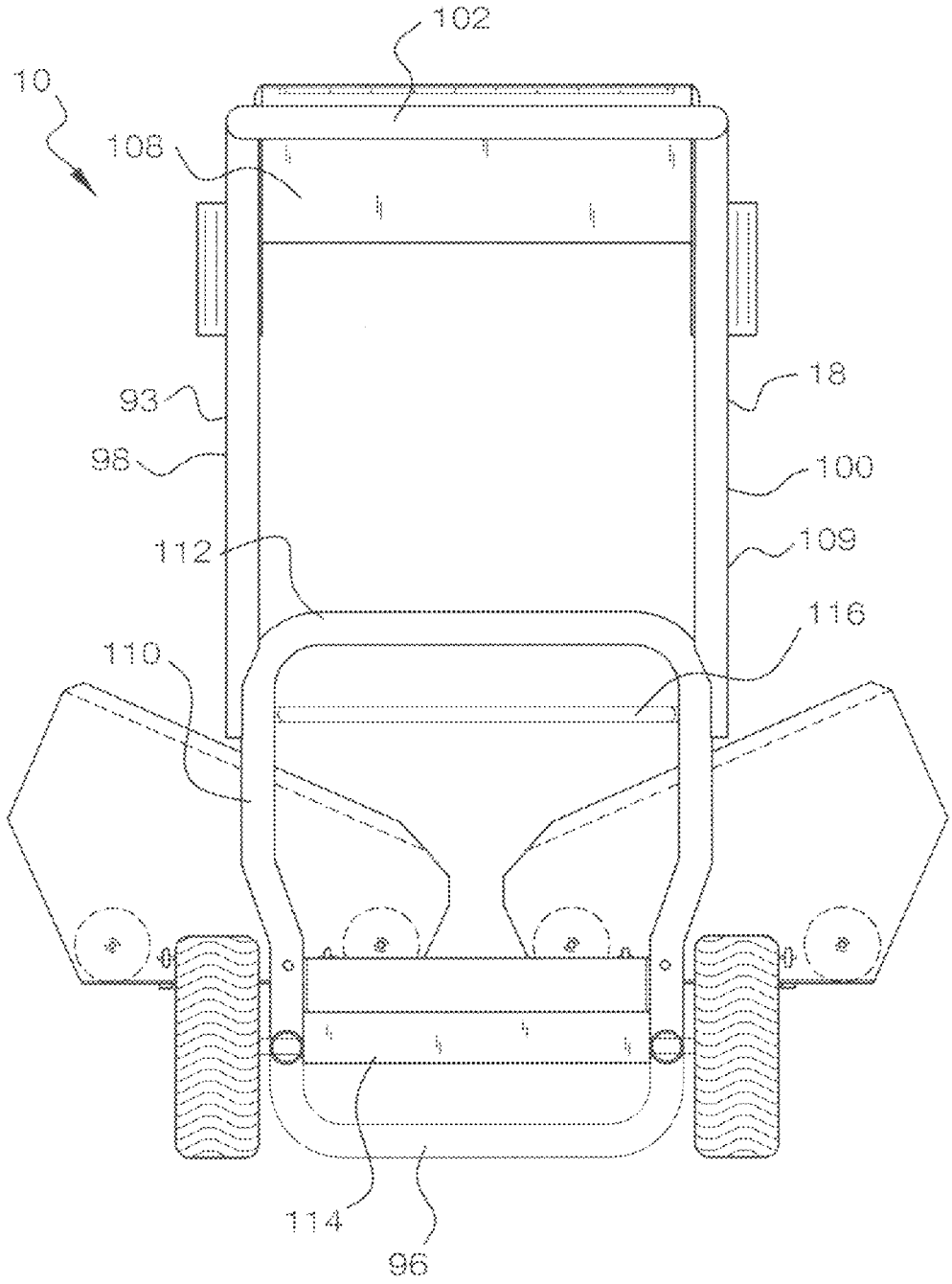
FIG. 7 is a back elevation view of the strap dispenser apparatus.
Figure 8:
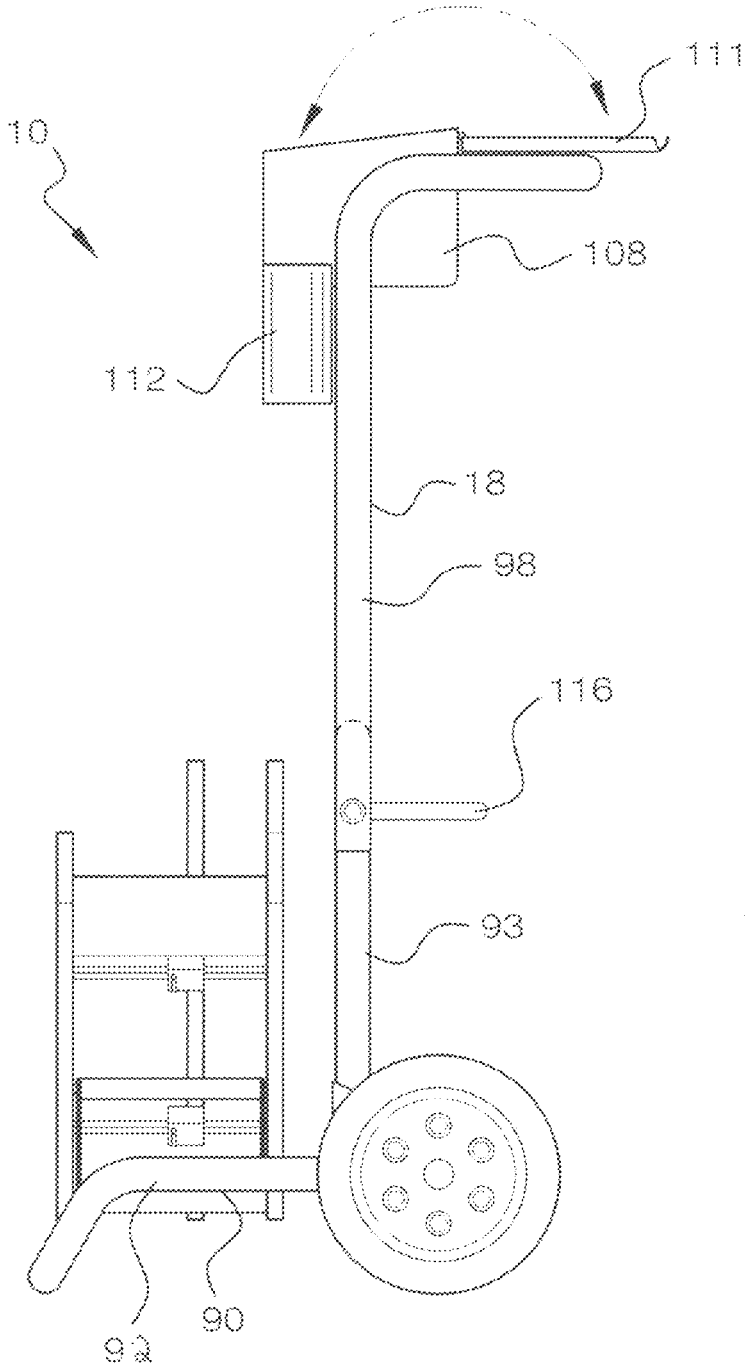
FIG. 8 is a side elevation view of the strap dispenser apparatus.

When the coil 14 is received by the carriage 12, carriage arms 36 and 42 each rotate such that ends 32 and 38 swing in a direction away from one another and ends 34 and 40 swing in a direction towards one another, thereby clamping the coil at circumferentially spaced locations around the periphery of the coil by the weight transfer rollers 20 and 22 and the force application devices 24 and 26. As the diameter of the coil 14 is reduced by pulling the strapping from the coil, the carriage arms 36 and 42 further rotate to maintain the weight transfer rollers 20 and 22 and the force application devices 24 and 26 in contact with the periphery of the coil, as shown in FIG. 4.

In this arrangement, the frictional force applied by the force application devices 24 and 26 to the coil 14 at the circumferential space locations on the periphery of the coil is proportional to the weight of the coil on the weight transfer rollers 20 and 22 respectively. More specifically, the frictional force applied by each force application device 24 and 26 is equal to the weight of the coil 14 on each weight transfer roller 20 and 22 multiplied by the second distance of attachment positions 48 and 50 respectively. The second distance of each attachment position 48 and 50 is fixed, thereby making the frictional force of the force application devices 24 and 26 proportional to the weight of the coil 14 on the weight transfer rollers 20 and 22.

Carriage arm 36 comprises two side plates 52 and 54 between which the first weight transfer roller 20 and the first force application device 24 are mounted at their respective ends. Likewise, carriage arm 42 comprises two side plates 56 and 58 between which the second weight transfer roller 22 and the second force application device 26 are mounted at their respective ends.

The carriage 12 may further include a coil guide arrangement 60 into which the coil 14 is placed as it is received by the carriage 12 for guiding the coil into alignment with the weight transfer rollers 20 and 22. The arrangement 60 is adjustable to the thickness of coil 14, and is adjusted so as to lightly contact the opposed sides of the coil. The arrangement 60 comprises a first pair of spaced and parallel guide plates 62 and 64 attached to the carriage 12 generally perpendicular to and extending across the first weight transfer roller 20 and the first force application device 24, and a second pair of spaced and parallel guide plates 66 and 68 attached to the carriage generally perpendicular to and extending across the second weight transfer roller 22 and the second force application device 26. More specifically, guide plates 62 and 64 extend in a direction upwardly from the first carriage arm 36, with guide plate 62 extending from side plate 52 and with guide plate 64 slidingly attached to guide bars 70 and 72 which extend between the side plates 52 and 54. Likewise, guide plates 66 and 68 extend in a direction upwardly from the second carriage arm 42, with guide plate 66 extending from side plate 56, and with guide plate 68 slidingly attached to guide bars 74 and 76, which extend between the side plates 56 and 58.

Figure 9:
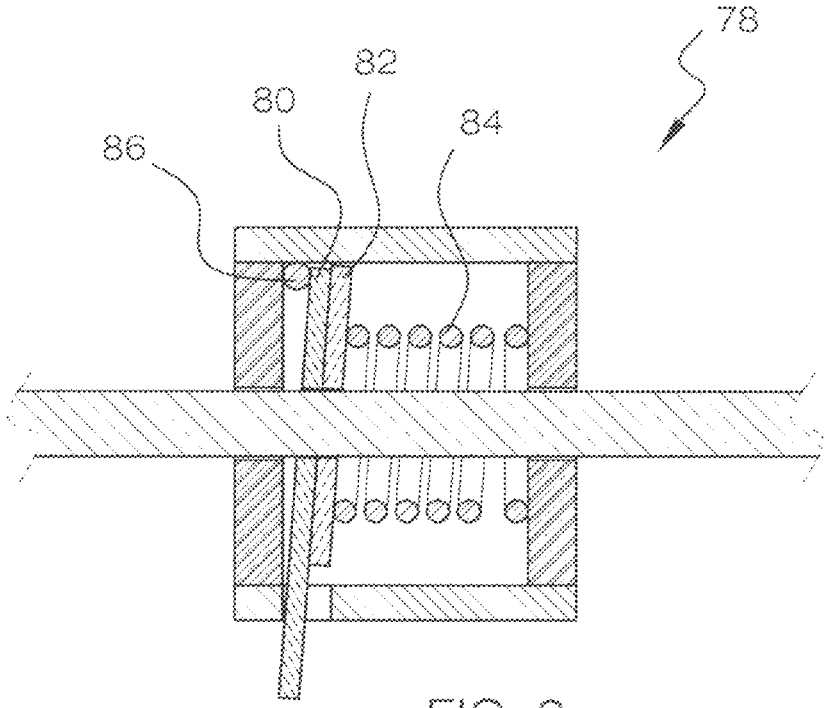
FIG. 9 is a cross sectional view of a lock used to secure the guide plates.

The spacing between guide plates 62 and 64, and the spacing between guide plates 66 and 68 are adjusted to fit the thickness of coil 14 by sliding guide plate 64 across the guide bars 70 and 72, and by sliding guide plate 68 across guide bars 74 and 76. The guide plates 66 and 68 are secured in place along their respective guide bars by locks 78. With reference to FIG. 9, each lock 78 may be of a standard bar lock comprising two parallel and juxtaposed plates 80 and 82 through which the bar passes, a spring 84 urging the plates together, and a roll pin 86 as illustrated.

The cart 18 includes a horizontal forward portion 90 of a generally U-shape in plan and a vertical rearward portion 93 of a generally U-shape in elevation. The side members 92 and 94 of the forward portion 90 are bent downwardly at the front and are joined by a middle member 96 as shown in FIGS. 1, 5, 6, 7 and 8. The middle member 96 forms a foot which supports the cart 18 in an upright position. A pair of wheels 104 and 106 are attached to the rear of side members 92 and 94 and providing rolling support to the cart 18. Side members 98 and 100 of the rearward portion 93 are bent rearwardly at the top and are joined by a cross member 102. The cross member 102 provides a grip for the operator in moving the cart 18 from place to place. The rearward portion 93 may comprise an upper portion 109 joined to a lower portion 110. A cross bar 112 may extend between side member 98 and 100 at the top of the lower portion 110. Supports 44 and 46 extend upwardly from side members 98 and 100 respectively.

The cart 18, may further include a number of receivers for storing tools and supplies used in the process of bundling articles together with strapping. For example, storage bin 108 may be positioned between the side members 98 and 100 at the top thereof for receiving various articles, such as tools and clips. The bin 108 may include a lid 111 hingedly attached an rear upper edge thereof that can be swung open, and supported by the rearwardly bent top portions of the side members 98 and 100 to provide a work table. The bottom of the bin 108 may comprise a grid or screen having openings of dimensions that retain the clips and tools stored therein but permits trash and debris to pass. One or more open ended tubular receivers 113 and 112 may be attached to opposite sides of the bin for receiving the handle of a tool therethrough for storage. A tray 114 may be positioned between the side member 98 and 100 towards the bottom thereof for supporting various tools. A tool retaining cross bar 116 may extend across the side members 98 and 100 at an elevation above the tray 114 to aid in retaining elongated tools vertically positioned tools within the tray 114.

Figure 2:
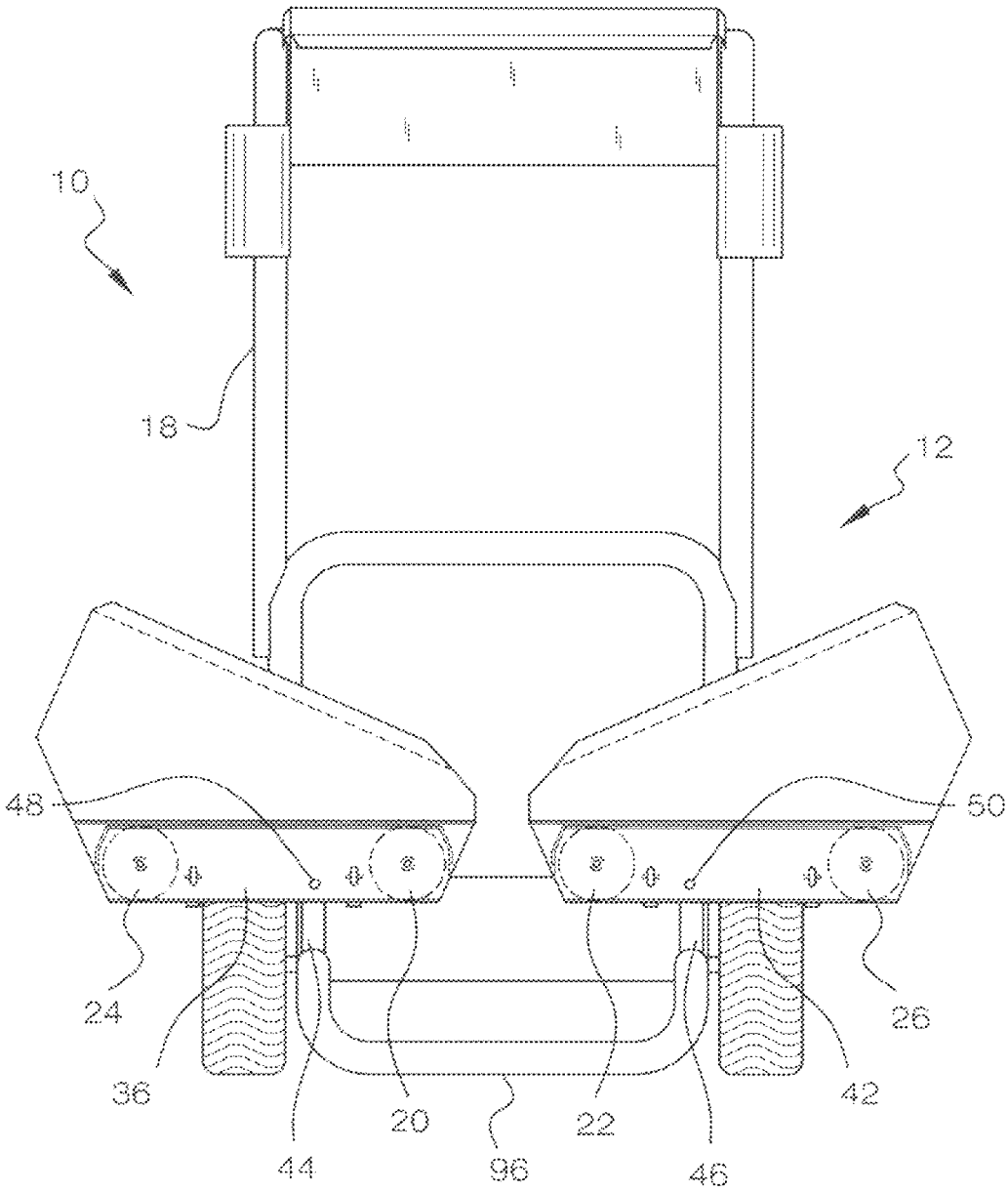
FIG. 2 is a front elevation view of the strap dispenser apparatus showing the carriage in a configuration ready to receive a coil of the strapping material.

In operation, the carriage 12 is arranged to receive a coil 14, as shown in FIG. 2. The coil 14 may be directly loaded into the carriage 12 either from the top, the front or the side onto the weight transfer rollers 20 and 22. Further, the coil 14 may be positioned to pay out the strapping from either side of the coil without making adjustments to the carriage 12. Additionally, the strapping can be pulled from the bottom of the coil 14, and thus, reducing the likelihood of tipping. The weight of the coil 14 causes the weight rollers 20 and 22 to move downwardly and outwardly in opposite directions. As the weight transfer rollers 20 and 22 move downwardly and outwardly in opposite directions, the force application devices 24 and 26 move inwardly towards each other to apply pressure on the coil 14. This pressure, maintains tension on the coil 14 as strapping is unwound from the coil and as the coil diameter is reduced. As strapping is removed, coil diameter is reduced and coil weight is reduced, resulting in less pressure being applied to the coil 14.

The carriage 12 does not require the coil 14 to have a core. Further, the coil 14 does not need supports such as rods or mandrels at its central, longitudinal axis. As long as the coil 14 fits into the carriage 12, coil size can very in length and in diameter without affecting coil placement and operation of the device 10 and the proportional braking applied to the coil. The tension for frictional force applied to the coil 14 at the circumferentially spaced locations on the periphery of the coil automatically adjusts based on the weight of the coil. A significant advantage, among others, of the design of the carriage 12 for receiving and supporting the coil 14 for rotation about a longitudinal axis of the coil by pulling the strapping from the coil to unwind the strapping from the coil is the independence of the carriage arms 36 and 42 being able to absorb some side-to-side movement of the coil as an operator pulls the strapping from the coil, which prevents tipping of the coil.

A number of embodiments of the present invention have been described. Nevertheless, it will be understood that various modifications may be made without departing from the spirit and scope of the invention. Accordingly, other embodiments are within the scope of the following claims.

We claim:

1. An apparatus permitting a material to be unwound from a coil of the material while applying a proportional braking force to the coil as the diameter of the coil is reduced by unwinding the material from the coil of the material, the apparatus comprising:

a carriage for receiving a coil of material such that the coil can be rotated about a longitudinal axis of the coil by pulling the material from the coil to unwind the material from the coil, said carriage including;

a first carriage arm having opposed first and second ends;

a second carriage arm having opposed first and second ends;

first and second laterally spaced and parallel weight transfer rollers;

first and second laterally spaced and parallel force application devices;

said first force application device is attached to said first end of said first carriage arm, and said first weight transfer roller is attached to said second end of said first carriage arm;

said second force application device is attached to said first end of said second carriage arm, and said second weight transfer roller is attached to said second end of said second carriage arm;

wherein said first carriage arm is pivotally attached to a first support at a position closer towards said first weight transfer roller than said first force application device;

wherein said second carriage arm is pivotally attached to a second support at a position closer towards said second weight transfer roller than said second force application device;

wherein said first and said second weight transfer rollers support the coil of material at circumferentially spaced locations on the periphery of the coil and are caused to moved downwardly and outwardly in opposite directions along separate and respective arcuate paths by the weight of the coil of material when the coil of material is received by said carriage;

wherein said first and said second force application devices are biased against and apply a braking force against the rotation of the coil of material about the longitudinal axis at circumferentially spaced locations on the periphery of the coil of material by the downwardly and outwardly movement of said first and said second weight transfer rollers respectively;

wherein a first and a second spaced, parallel guide plates attached to said first carriage arm for rotation therewith and transverse to said first weight transfer roller and said first force application device, the coil of material being positionable between said first and said second guide plates when the coil of material is received by said carriage;

wherein a third and a fourth spaced, parallel guide plates attached to said second carriage arm for rotation therewith and transverse to said second weight transfer roller and said second force application device, the coil of material being positionable between said third and said fourth guide plates when the coil of material is received by said carriage; and wherein the spacing between said first and said second guide plates and a spacing between said third and fourth guide plates are adjustable to accommodate the width of the coil of material.

2. The apparatus of claim 1, wherein said braking force is applied as a function of the weight of the coil of material on said first and said second weight transfer rollers.

3. The apparatus of claim 1, wherein said first carriage arm includes two side plates between which said first weight transfer roller and said first force application device are mounted; and wherein said second carriage arm includes two side plates between which said second weight transfer roller and said second force application device are mounted.

4. The apparatus of claim 1, wherein said first and said second force application devices includes brake rollers which apply said braking force to the rotation of the coil of material when biased against the coil of material.

5. The apparatus of claim 1, wherein said first force application device and said first weight transfer roller are free from intermediate rollers positioned therebetween; and wherein said second force application device and said second weight transfer roller are free from intermediate rollers positioned therebetween.

6. The apparatus of claim 5, wherein said first and said second force application devices are brake rollers.

7. The apparatus of claim 1, further comprising:

a wheeled frame; and said carriage attached to said wheeled frame.

* * * * *